US007484506B2

(12) United States Patent
Besal

(10) Patent No.: US 7,484,506 B2
(45) Date of Patent: Feb. 3, 2009

(54) ROOFTOP GREASE CONTAINMENT SYSTEM AND METHODS OF MAKING AND USING THE SAME

(76) Inventor: Bernard P. Besal, 3419 Breton Ct., Atlanta, GA (US) 30319

( * ) Notice: Subject to any disclaimer, the term of this patent is extended or adjusted under 35 U.S.C. 154(b) by 624 days.

(21) Appl. No.: 10/924,425

(22) Filed: Aug. 24, 2004

(65) Prior Publication Data

US 2006/0042621 A1 Mar. 2, 2006

(51) Int. Cl.
*F24C 15/32* (2006.01)

(52) U.S. Cl. ..... 126/299 E; 454/16; 454/356; 454/358; 126/312

(58) Field of Classification Search ..... 126/299 R, 126/299 D, 299 E; 55/DIG. 36; 134/34; 454/49, 366, 358, 341, 356, 368
See application file for complete search history.

(56) References Cited

U.S. PATENT DOCUMENTS 3,393,497 A * 7/1968 Donnelly ..... 126/299 D
4,869,236 A * 9/1989 Blough ..... 126/299 R
4,977,884 A * 12/1990 Kaufman ..... 126/299 R
5,472,342 A * 12/1995 Welsh et al. ..... 126/299 E
5,814,115 A * 9/1998 Allen et al. ..... 55/DIG. 36
6,143,047 A * 11/2000 Jodoin et al. ..... 55/DIG. 36
6,468,323 B1 * 10/2002 Chwala ..... 55/490
6,716,099 B2 * 4/2004 Pfleiderer et al. ..... 454/41

FOREIGN PATENT DOCUMENTS

CA 2293146 A1 * 6/2001

* cited by examiner

*Primary Examiner*—Steven B McAllister
*Assistant Examiner*—Sarah Suereth
(74) *Attorney, Agent, or Firm*—Withers & Keys, LLC

(57) ABSTRACT

Rooftop grease containment systems are disclosed. The disclosed grease containment systems may include a grease collection pan having (i) a pan volume surrounded by (a) a pan floor, (b) at least one pan side wall, and (c) a pan rim extending outward from an upper edge of the at least one pan side wall, (ii) at least one pan drain outlet, and (iii) at least one pan opening positioned in the pan floor, the first pan opening having a size and shape so that a first grease duct extending through a roof structure can extend through the first pan opening. The disclosed grease containment systems may further include a roof curb extending upward from the roof structure and having a roof curb upper periphery, the grease collection pan being positioned on the roof curb so that the pan rim rests on the roof curb upper periphery of the roof curb. Methods of making and using the disclosed rooftop grease containment systems are also disclosed.

25 Claims, 6 Drawing Sheets

ROOFTOP GREASE CONTAINMENT SYSTEM AND METHODS OF MAKING AND USING THE SAME

FIELD OF THE INVENTION

The present invention relates to rooftop grease containment systems. The present invention further relates to methods of making and using rooftop grease containment systems.

BACKGROUND OF THE INVENTION

Commercial kitchen exhaust removal systems are employed as a primary method of ventilating the workspace for chefs, foodservice personnel, and the patrons of foodservice establishments. As the grease-laden vapor is emitted from the cooking appliance line, the plume generated by the heating of the cooking rises into the kitchen exhaust system along with grease vapor, combustion by-products, and airborne contaminants.

As a fire prevention measure intended to reduce the quantity of cooking grease into the kitchen exhaust removal system, filtering of the kitchen exhaust is provided at the source of the exhaust hood, prior to the exhaust duct itself. However, traditional means of filtering the exhaust only trap a small percentage of grease and associated contaminants within the exhaust air stream. Consequently, grease-laden vapor is pulled through the primary grease removal device, and deposited on the components of the kitchen exhaust removal system including the exhaust filters, hood plenum, exhaust ductwork, and the exhaust blower.

Deposited grease within the exhaust filters, hood plenum, exhaust ductwork, and the exhaust blower must be regularly removed by a professional cleaning contractor in order to prevent fires within the kitchen exhaust removal system. Cleaning of the kitchen exhaust system normally involves cleaning of the exhaust blower, interior of the vertical and horizontal exhaust ductwork, the exhaust hood filters, plenum areas, and the exhaust hood interior itself. Such professional cleaning usually involves processes such as steam cleaning and/or pressure washing.

As cooking appliances are used on a daily basis, deposition of grease occurs greatest nearest the source of the cooking appliances, and daily reheating of the appliances will tend to re-liquefy grease residue deposited within the exhaust filter, plenum areas, and the exhaust ductwork. Natural migration of this deposited by-product induced by the exhaust blower leaves a continuous stream of grease, beginning at the grease removal device, through the interior of the exhaust ductwork, and into the exhaust blower. The interior of the exhaust blower typically experiences rapid grease soiling due to (i) fluid flow of the grease-containing air stream through the exhaust blower, (ii) paddling of the grease-containing air stream by exhaust blower blades, and (iii) the change in direction of the grease-containing air stream via the exhaust blower cowl or blower scroll housing (depending upon design), and discharge if applicable.

Between professional exhaust cleaning operations, significant volumes of grease can accumulate within the exhaust blower itself and within the exhaust ductwork. Leakage of grease from the exhaust blower housing onto the roof surface remains an ongoing challenge for many foodservice establishments. Cooking by-products damage almost all commercial roofing materials available today, and impact of the destruction of commercial roofing at foodservice establishments due to grease potentially interrupts bonds or warranties offered by the roofing installer, the contractor, and/or the construction company.

Although attempts have been made to address the problem of grease accumulation on rooftops of buildings, traditional treatment measures to date are inadequate. There exists a need in the art of effective methods and products for addressing the problem of accumulation of grease within a kitchen exhaust removal system, as well as on a building rooftop.

SUMMARY OF THE INVENTION

The present invention addresses some of the difficulties and problems discussed above by the discovery of grease containment systems, which control and contain grease during (i) normal use and (ii) cleaning of kitchen exhaust systems. The grease containment systems of the present invention allow separation and containment of grease leaking from an exhaust blower of a kitchen exhaust system between professional cleanings of the system. Further, grease containment systems of the present invention enable control of the grease discharged from an exhaust blower during cleaning of the exhaust blower.

Accordingly, in one exemplary embodiment, the present invention is directed to a grease containment system comprising a grease collection pan having (i) a pan volume surrounded by (a) a pan floor, (b) at least one pan side wall, and (c) a pan rim extending outward from an upper edge of the at least one pan side wall, (ii) at least one pan drain outlet, and (iii) at least one pan opening positioned in the pan floor, wherein a first pan opening has a size and shape so that a first grease duct extending through a roof structure can extend through the first pan opening. The exemplary grease containment system may further comprise a number of additional components to control fluid flow of grease and grease-containing solutions. Additional components include, but are not limited to a roof curb extending upward from the roof structure and having a roof curb upper periphery; exhaust penetration fitting extending through the first pan opening or resting on an upper surface of the grease collection pan; an exhaust penetration fitting flange; least one pipe extending from the pan opening of the grease collection pan; a grease collection unit, such as a grease trap; one or more electrical service disconnect mounts; one or more weatherproof lights; one or more electrical outlets; and a water piping assembly.

The present invention is further directed to a method of reducing an amount of grease on a rooftop of a building, wherein the method comprises positioning a grease containment system around and beneath an exhaust fan of a rooftop kitchen exhaust system, wherein the grease containment system comprises a grease collection pan having (i) a pan volume surrounded by (a) a pan floor, (b) at least one pan side wall, and (c) a pan upper rim extending outward from an upper edge of the at least one pan side wall, (ii) at least one pan drain outlet, and (iii) at least one pan opening positioned in the pan floor, wherein a first pan opening has a size and shape so that a first grease duct extending through a roof structure and to the exhaust fan can extend through the first pan opening. The method of reducing an amount of grease on a rooftop of a building may further comprise a number of additional steps including assembling one or more additional components of the grease containment system with one another to reduce the amount of grease on a rooftop.

The present invention is even further directed to a method of cleaning a rooftop kitchen exhaust system of a building, wherein the method comprises (a) positioning a grease containment system around and beneath an exhaust fan of a rooftop kitchen exhaust system, wherein the grease containment system comprises a grease collection pan having (i) a pan volume surrounded by (a) a pan floor, (b) at least one pan side wall, and (c) a pan upper rim extending outward from an upper edge of the at least one pan side wall, (ii) at least one pan drain outlet, and (iii) at least one pan opening positioned in the pan floor, wherein a first pan opening has a size and shape so that a first grease duct extending through a roof structure and to the exhaust fan can extend through the first pan opening; (b) contacting one or more components of the rooftop kitchen exhaust system with an aqueous solution; and (c) collecting the aqueous solution and any grease dislodged from the one or more components of the rooftop kitchen exhaust system in the grease containment system, wherein the aqueous solution and the grease travel through the at least one pan drain outlet to a grease collection unit, such as a grease trap.

These and other features and advantages of the present invention will become apparent after a review of the following detailed description of the disclosed embodiments and the appended claims.

DETAILED DESCRIPTION OF THE INVENTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

The present invention is directed to grease containment systems and methods of making and using grease containment systems, especially for rooftop applications. The disclosed grease containment systems may be used to control and contain grease in a variety of kitchen exhaust systems, especially commercial kitchen exhaust systems. The disclosed grease containment systems may be designed to be used with newly constructed kitchen exhaust systems or retrofitted for existing kitchen exhaust systems.

Figure 1:
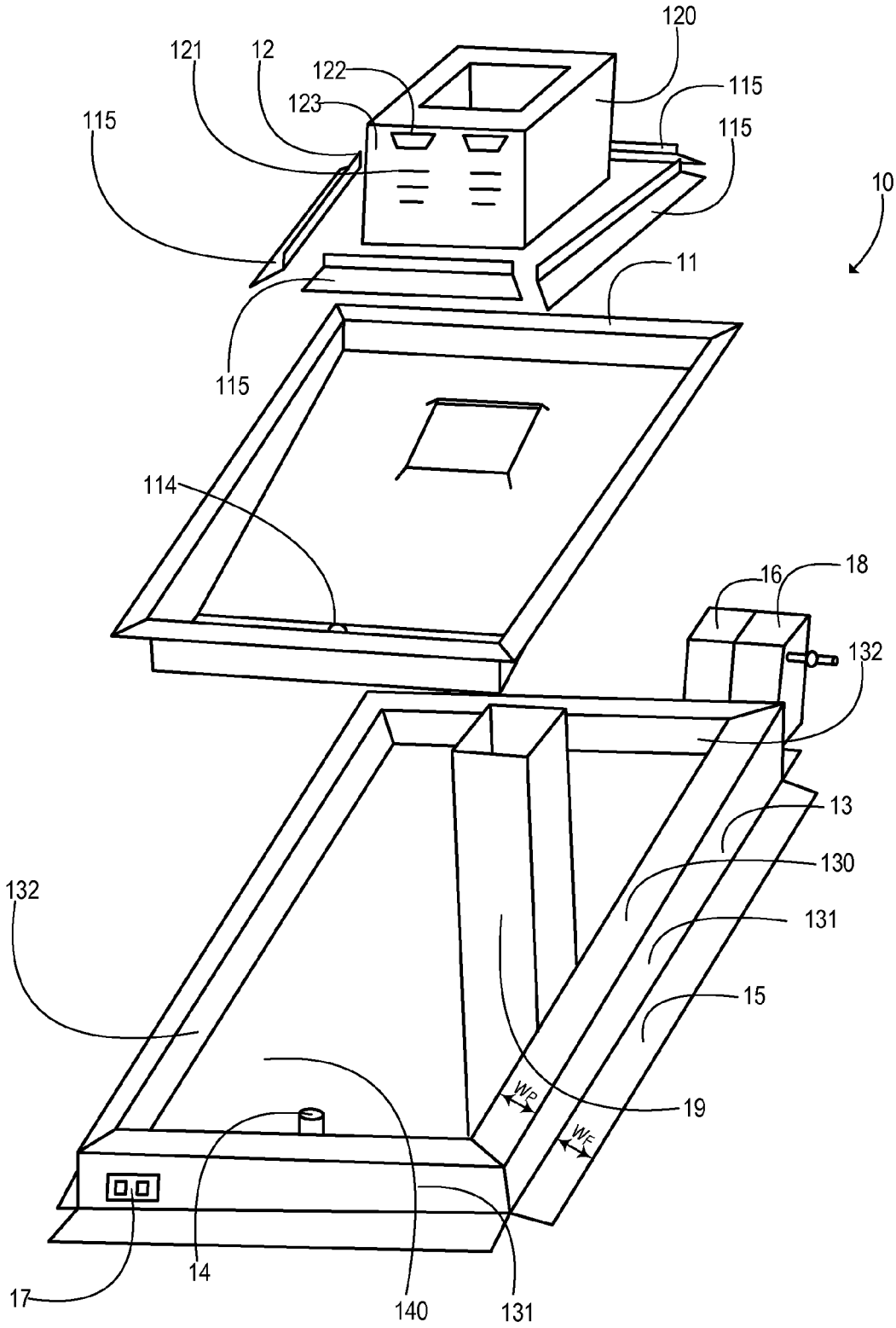
FIG. 1 depicts a view of an exemplary grease pan of the present invention.

The grease containment systems of the present invention comprise one or more components. One exemplary grease containment system 10 of the present invention is shown in FIG. 1. Exemplary grease containment system 10 comprises grease pan 11, exhaust penetration fitting 12, roof curb 13, and drain pipe 14. Drain pipe 14 leads to a grease collection system, such as a grease trap (not shown), located below the rooftop surface. Exemplary grease containment system 10 may further comprise a number of optional components such as base flange footing 15, exhaust penetration fitting flange 115, exhaust blower fan power disconnect 16, electrical outlet 17, high-pressure wash piping 18, and weatherproof lighting (not shown).

As shown by exemplary grease containment system 10 in FIG. 1, the grease containment systems of the present invention may comprise a number of components. A description of individual components and methods of using individual components alone or in combination with one another is provided below.

I. Grease Containment System Components

The grease containment systems of the present invention may comprise, but are not limited to, one or more of the following components.

A. Grease Pan

Figure 2:
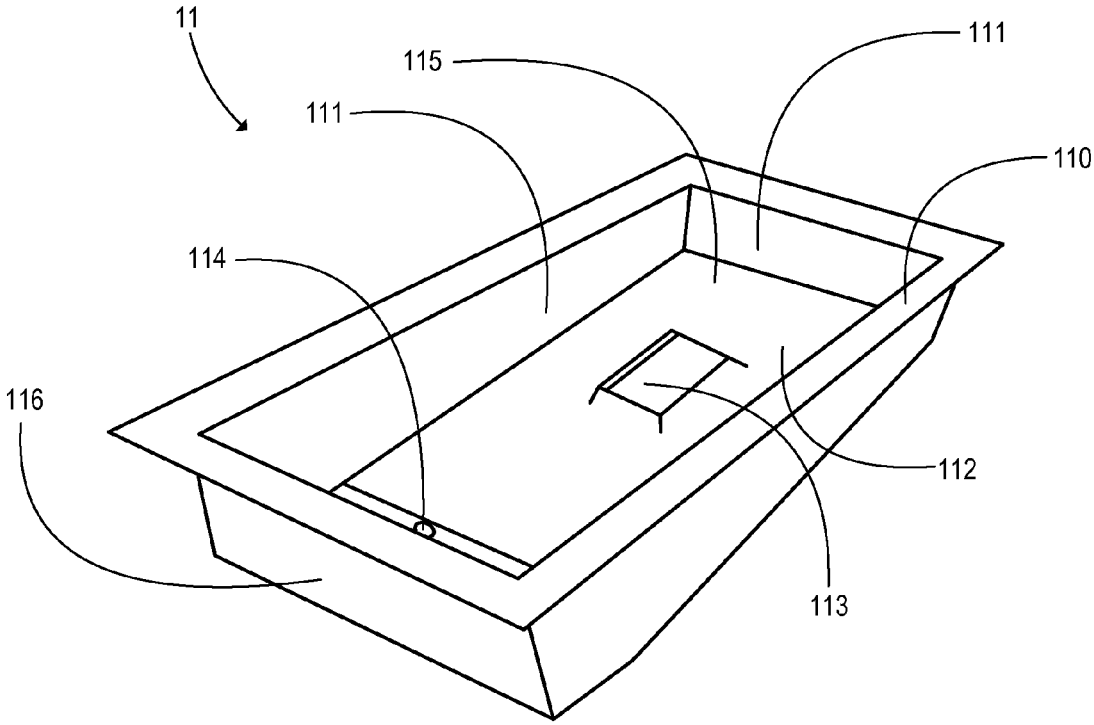
FIG. 2 depicts a side view of the exemplary grease pan of FIG. 1 from point A.
Figure 3:
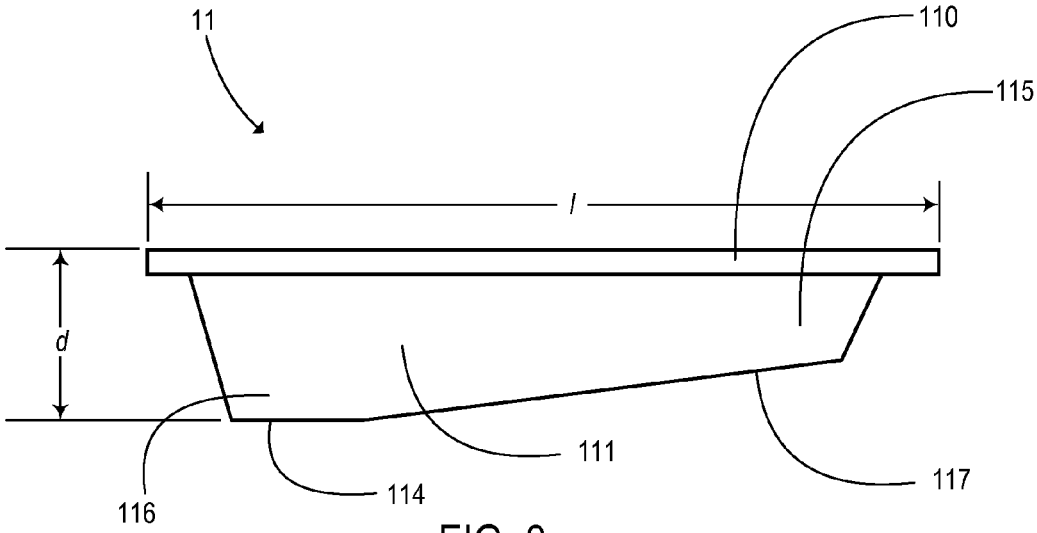
FIG. 3 depicts a side top view of the exemplary grease pan of FIG. 1.
Figure 4:
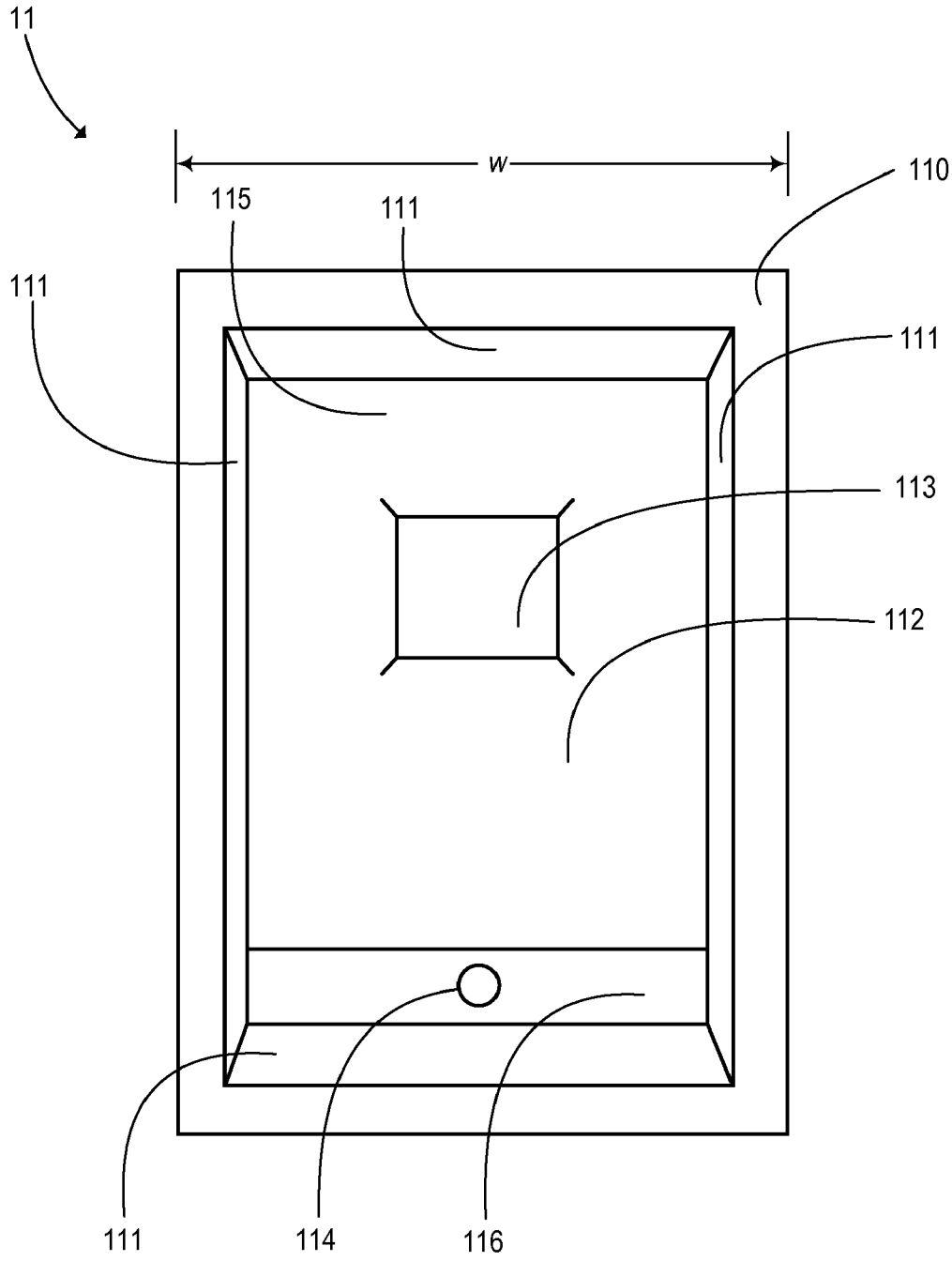
FIG. 4 depicts a top view of the exemplary grease pan of FIG. 1 in combination with exemplary components of an exemplary rooftop grease containment system of the present invention.

The grease containment systems of the present invention comprise at least one grease pan, such as exemplary grease pan 11 shown in FIG. 1. Grease pans are used to control the flow of grease and/or grease-containing solutions in and around a grease contaminated area, such as a rooftop exhaust fan of a kitchen exhaust system. As shown in FIGS. 2-4, grease pans used in the present invention typically possess a number of features, which enable efficient fluid flow control of grease and grease-containing solutions.

As shown in FIG. 2, exemplary grease pan 11 comprises upper rim 110 that extends along an upper periphery of exemplary grease pan 11. Upper rim 110 extends outward from one or more side walls 111 of exemplary grease pan 11. As shown in FIG. 2, exemplary grease pan 11 comprises four side walls 111; however, it should be understood that exemplary grease pan 11 may comprise any number of side walls depending on the shape of exemplary grease pan 11. For example, a circular grease pan may comprise a single side wall, while an octagonal shape grease pan may comprise eight side walls.

Exemplary grease pan 11 further comprises a lower surface 112 surrounded by side walls 111, a first duct opening 113 within lower surface 112, and a drain opening 114 within lower surface 112. First duct opening 113 is sized such that a duct extending from a grease-generating source can extend through first duct opening 113 (See, for example, exemplary duct 19 in FIG. 1 extending upward toward exemplary grease pan 11). In one embodiment of the present invention, first duct opening 113 has an opening size and shape such that edges of first duct opening 113 are substantially next to outer edges of a duct extending through first duct opening 113 (e.g., the duct has a circular outer circumference having a circumference length of about 48 cm., and first duct opening 113 has a circular opening having a circumference length of about 48 cm. or slightly greater than 48 cm.).

In a further embodiment of the present invention, first duct opening 113 has an opening size and shape such that edges of first duct opening 113 are not next to outer edges of a duct extending through first duct opening 113. In this embodiment, a desired spacing is present between edges of first duct opening 113 and outer edges of a duct extending through first duct opening 113. For example, the duct may have a circular outer circumference and a diameter of 15.2 cm. (6.0 in.), while first duct opening 113 may have a square opening having a side length of 106.7 cm. (42 in.) (i.e., a 45.7 cm. (18 in.) clearance between edges of first duct opening 113 and outer edges of a duct extending through first duct opening 113). First duct opening 113 may have any desired shape including, but not limited to, a circular, rectangular, or square shape to accommodate a duct penetrating the rooftop.

As shown in FIG. 2, drain opening 114 is located at a lowest point of grease pan 111. Drain opening 114 may be connected to drain piping (see, for example, drain pipe 14 in FIG. 1), which leads to a grease collection system, such as a grease trap or grease removal unit (not shown), located at a remote location below the rooftop surface. The remote grease trap or grease removal unit may be located in the kitchen, on a floor of a building below the roof, in a basement of a building, at a location outside but near a building, or any other remote location.

Exemplary grease pan 11 may have any desired dimensions depending on a given grease containment system. Typically, grease pan 11 has an overall length, l, (i.e., the dimension extending from first end 115 to second end 116 of exemplary grease pan 11) (see, distance l shown in FIG. 3) ranging from about 91.4 cm. (10 ft.) to about 365.8 cm. (12 ft.); an overall width, w, (i.e., the dimension perpendicular to the length) (see, distance w shown in FIG. 4) ranging from about 91.4 cm. (3 ft.) to about 304.8 cm. (10 ft.); a depth, d, (i.e., the dimension extending from upper rim 110 to lowermost surface 117 of exemplary grease pan 11) (see, distance d shown in FIG. 3) ranging from about 10.2 cm. (4.0 in.) to about 61.0 cm. (24 in.).

Further, each duct opening, such as first duct opening 113, present in the grease pan of the present invention may have any size or shape as desired to provide a throughput for one or more ducts. Typically, each duct opening has a circular, rectangular, or square shape, and one or more dimensions (i.e., diameter, length or width) ranging from about 10.2 cm. (4.0 in.) to about 61.0 cm. (24 in.). In addition, each drain opening, such as drain opening 114, present in the grease pan of the present invention may have any size or shape as desired to provide an outlet for fluids in the grease pan. Typically, each drain opening (e.g., for each of the one or more drains in the grease pan) has a circular or square shape, and one or more dimensions (i.e., diameter, length or width) ranging from about 5.1 cm. (2.0 in.) to about 15.2 cm. (6 in.).

The upper rim of the grease pan, such as upper rim 110 of exemplary grease pan 11, typically extends outward a distance ranging from about 2.5 cm. (1.0 in.) to about 20.3 cm. (8.0 in.) so that the grease pan can rest on an upper periphery of a curb system described below (such as roof curb 13 shown in FIG. 1). The upper rim length will depend on a number of factors including, but not limited to, the width of the upper periphery of the roof curb, the size of the grease pan, and the desired load capacity of the grease pan.

The grease pan of the grease containment systems of the present invention are typically made from materials that (i) resist damage from water, weather, and grease, and (ii) have a material thickness that provides desired load-bearing strength. Suitable materials for forming grease pans of the present invention include, but are not limited to, metals such as stainless steel, and fiber-reinforced composite materials. The thickness of a given material may vary depending on the material used; however, the materials typically have a wall thickness ranging from about 1.09 mm (0.043 in.) to about 3.18 mm (0.125 in). Desirably, the grease pan is formed from stainless steel having a thickness ranging from about 1.09 mm (0.043 in.) to about 1.37 mm (0.054 in.).

Grease pans of the present invention may be formed using conventional methods. Suitable methods include, but are not limited to, stamping processes, rolling processes, and molding processes. Grease pans may be custom built for a given application and a given grease containment system.

To increase the load-bearing capacity of the grease pan, additional support may be used in combination with the grease pan. For example, bracing beneath the grease pan (i.e., within containment curb volume 140 as shown in FIG. 1) may be used to provide additional support to the grease pan.

B. Curb System

Figure 5:
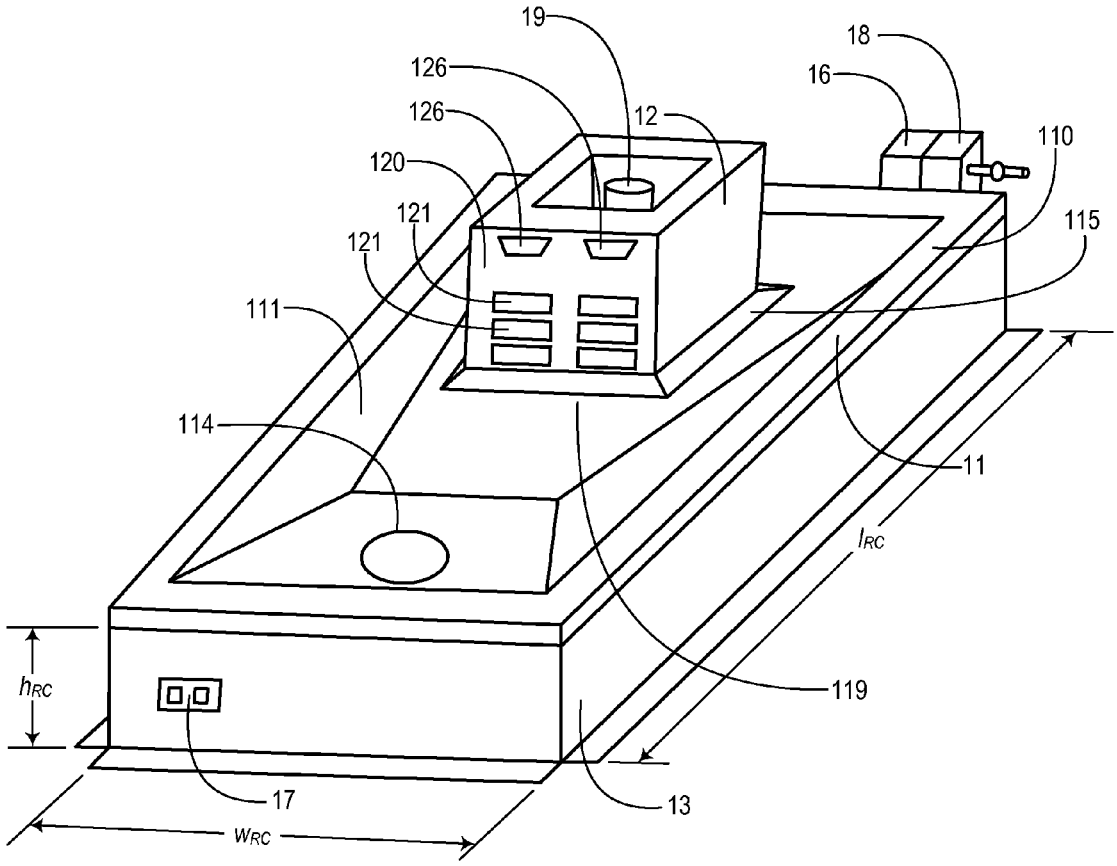
FIG. 5 depicts a view of the exemplary rooftop grease containment system of FIG. 4 wherein the exemplary components are assembled with one another.

The grease containment system of the present invention further comprises a curb system, such as exemplary roof curb 13 of exemplary grease containment system 10 shown in FIG. 1. As shown in FIG. 5, exemplary grease pan 11 sits atop an upper periphery 130 of exemplary roof curb 13, and extends downward into containment curb volume 140 (see, FIG. 1).

As shown in FIGS. 1 and 5, exemplary roof curb 13 comprises upper periphery 130, one or more side walls 131, and an optional base flange 15 extending from a lower portion of one or more side walls 131. Exemplary roof curb 13 has a rectangular configuration; however, the roof curbs of the present invention may have any desired configuration including, but not limited to, a circular configuration, a square configuration, an oblong configuration, or an octagonal configuration and possibly downward along inner curbside walls.

The curb system surrounds one or more grease ducts of a kitchen exhaust system extending through a rooftop. Typically, for new rooftop construction, the curb system is placed on top of a dried-in roof so as to surround the vertical penetration of the kitchen exhaust system ductwork. In one desired embodiment of the present invention, roofing material for the roof is applied from the roof surface, over optional base flange 15, up the one or more side walls 131, over the top of the roof curb (i.e., over upper periphery 130), and downward along inner curb side walls 132 within containment curb volume 140 (see, FIG. 1). Any conventional roofing materials may be used with the grease containment systems of the present invention.

During new construction or retrofitting of an existing kitchen exhaust system, temporary placement of a grease pan into a roof curb system allows the installer to mark locations for the grease duct and the drain opening. Once these openings are roughed in, the grease pan may be placed on top of the roof curb system as shown in FIG. 5.

FIG. 5 depicts the grease containment system of FIG. 1, wherein all of the exemplary components are positioned relative to one another. As shown in FIG. 5, upper rim 110 of exemplary grease pan 11 extends over upper periphery 130 of exemplary roof curb 13 to prevent weather elements (e.g., rain, etc.) from entering into a containment curb volume (see, containment curb volume 140 shown in FIG. 1). Further, as discussed above, the load-bearing strength of exemplary grease pan 11 allows trim back of any combustible roof decking material, such as wood, a desired distance from the exhaust duct penetration. For example, in some states, building codes mandate that the clearance between a grease duct and any combustible roof decking material be at least 45.7 cm. (18 in.).

Similar to the dimensions of exemplary grease pan 11 discussed above, exemplary roof curb 13 may have any desired dimensions depending on a given grease containment system. Typically, roof curb 13 has an overall length, $l_{RC}$, (see, distance $l_{RC}$ shown in FIG. 5) ranging from about 121.9 cm. (4 ft.) to about 365.8 cm. (12 ft.); an overall width, $w_{RC}$, (see, distance $w_{RC}$ shown in FIG. 5) ranging from about 121.9 cm. (4 ft.) to about 365.8 cm. (12 ft.); and a height, $h_{RC}$, (see, distance $h_{RC}$ shown in FIG. 5) ranging from about 2.5 cm. (1.0 in.) to about 15.2 cm. (6 in.).

Further, the upper periphery of the roof curb, such as upper periphery 130 of exemplary roof curb 13, typically has a width, $w_p$, (see, distance $w_p$ shown in FIG. 1) ranging from about 5.1 cm. (2.0 in.) to about 15.2 cm. (6.0 in.) so that an upper rim of a grease pan can rest on the upper periphery. When present, a roof curb base flange, such as base flange 15, typically extends outward a distance, $w_F$, (see, distance $w_F$ shown in FIG. 1) ranging from about 2.5 cm. (1.0 in.) to about 15.2 cm. (6 in.).

Like the grease pans described above, the roof curb suitable for use in the grease containment systems of the present invention are typically made from materials that (i) resist damage from water, weather, and grease, and (ii) have a material thickness that provides desired load-bearing strength. Suitable materials for forming roof curbs of the present invention include, but are not limited to, metals such as stainless steel, and fiber-reinforced composite materials. The thickness of a given material may vary depending on the material used; however, the materials typically have a wall thickness ranging from about 1.09 mm (0.043 in.) to about 3.18 mm (0.125 in). Desirably, the roof curb is formed from stainless steel having a thickness ranging from about 1.09 mm (0.043 in.) to about 1.37 mm (0.054 in.).

Typically, the roof curb and grease pan provide a grease containment system that can withstand a load applied onto an upper area of the grease pan of up to about 800 pounds (lb.). The roof curb/grease pan assembly is capable of bearing the weight of one or more persons standing in the grease pan while performing maintenance and/or cleaning of an exhaust blower fan positioned above or next to the grease pan.

C. Exhaust Penetration Fitting

The grease containment system of the present invention further comprises an optional exhaust penetration fitting, such as exemplary exhaust penetration fitting 12 shown in FIG. 1. The exhaust penetration fitting may be a base fitting or a ventilated base fitting used to (i) provide an insulating barrier around more or more grease ducts extending through a roof structure, (ii) provide a base support for an exhaust blower fan, such as an upblast exhaust fan, or both (i) and (ii).

In one desired embodiment of the present invention, the exhaust penetration fitting comprises a ventilated base fitting capable of supporting an upblast exhaust fan. Exemplary exhaust penetration fitting 12 shown in FIG. 1 is an example of such a ventilated base fitting. As shown in FIG. 1, exemplary exhaust penetration fitting 12 comprises a tubular base structure 120, and one or more vents 121 in at least one side wall 123 of tubular base structure 120. Vents 121 may be present in any number, and each vent may have any desired size and shape.

In this embodiment, exemplary exhaust penetration fitting 12 desirably comprises one or more hinges 122 on one side wall of tubular base structure 120 (in this case, side wall 123). One or more hinges 122 may be connected to portions of an upblast exhaust fan (not shown). During cleaning of the upblast exhaust fan, the upblast exhaust fan may be tilted over a portion of the grease pan so that any cleaning solution, grease, and/or grease-containing solutions fall into the grease pan, and are contained within the grease containment system. (See, FIG. 6, wherein upblast exhaust fan 64 tilts in the direction shown by arrow H). Desirably, when present, the one or more hinges 122 are positioned on a side wall of tubular base structure 120 so that an upblast exhaust fan can be tilted toward a grease-collection area of the grease pan, typically, toward the drain opening of the grease pan. See, for example, FIGS. 1, 5 and 6 wherein hinges 122 are positioned so as to face drain opening 114 of grease pan 11.

Figure 6:
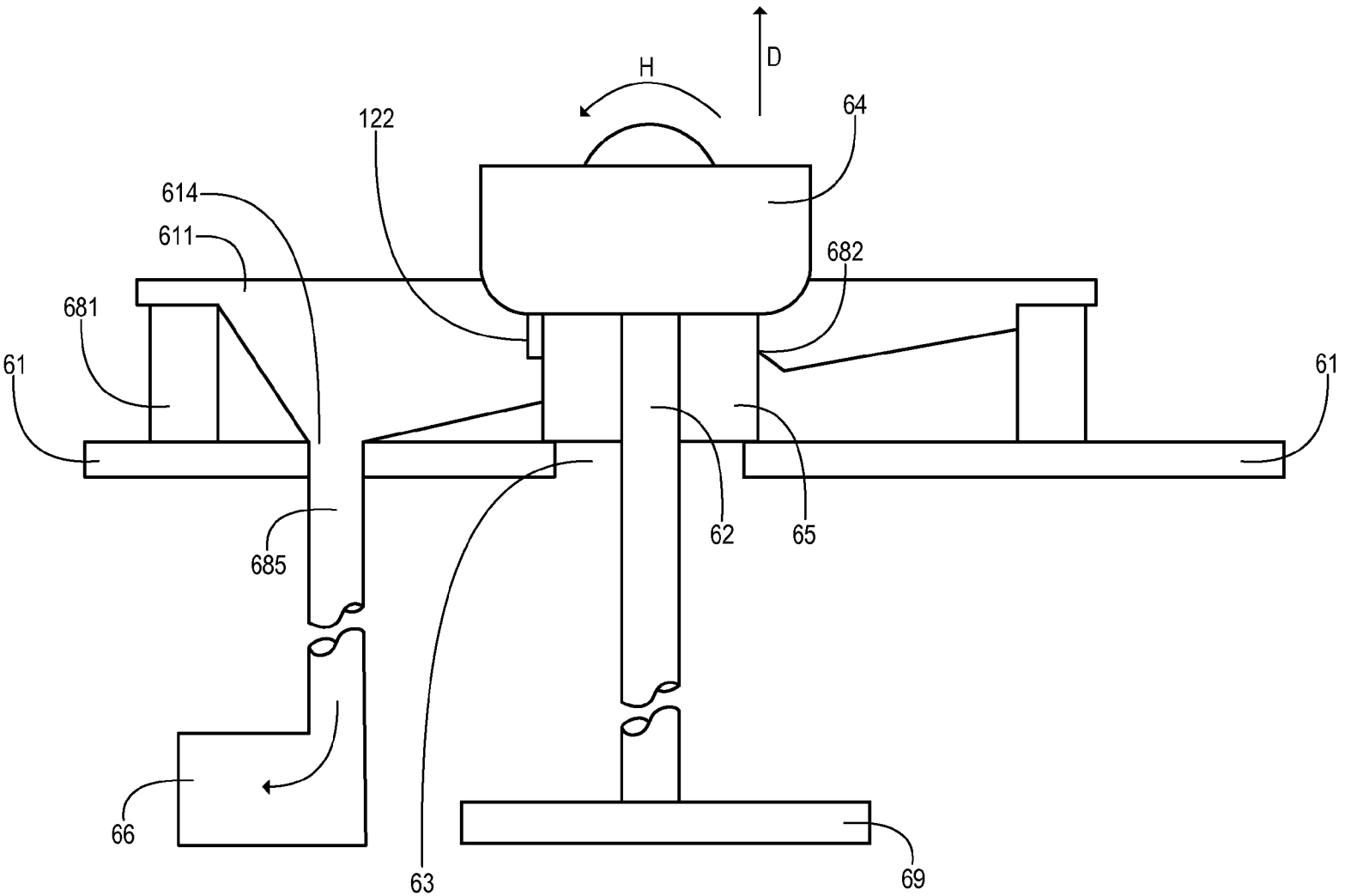
FIG. 6 depicts a cross-sectional view of an exemplary rooftop grease containment system of the present invention for use with an upblast exhaust fan.

A further embodiment of the present invention is shown in FIG. 6. In this exemplary embodiment, exhaust penetration fitting 65 rests on roof structure 61 and encompasses a portion of grease duct 62 extending through grease duct opening 63 in roof structure 61. Grease duct 62 extends from a grease source 69, such as a kitchen grease hood, to upblast exhaust fan 64 having an air discharge direction as shown by arrow D. Exhaust penetration fitting 65 may contain one or more access panels (not shown) to facilitate cleaning of exhaust penetration fitting 65 during regularly scheduled maintenance. Further, exhaust penetration fitting 65 may contain one or more vents (not shown) as described above.

As shown in FIG. 6, upblast exhaust fan 64 desirably sits atop exhaust penetration fitting 65 to elevate upblast exhaust fan 64 a desired distance above roof structure 61. Exemplary grease pan 611 rests on roof curb 681, and comprises first duct opening 682 for exhaust penetration fitting 65, and drain opening 614. Drain opening 614 leads to drain piping 685, which directs grease and grease-containing solutions to grease collection system 66, such as a grease trap. As shown in FIG. 6, edges of exemplary grease pan 611 surrounding first duct opening 682 may be modified in order to prevent grease and/or grease-containing solutions from entering into first duct opening 682. Alternatively, an exhaust penetration fitting flange, such as flange 115 as shown in FIG. 5, may be used with exhaust penetration fitting 65 to prevent grease and/or grease-containing solutions from entering into first duct opening 682.

Figure 7:
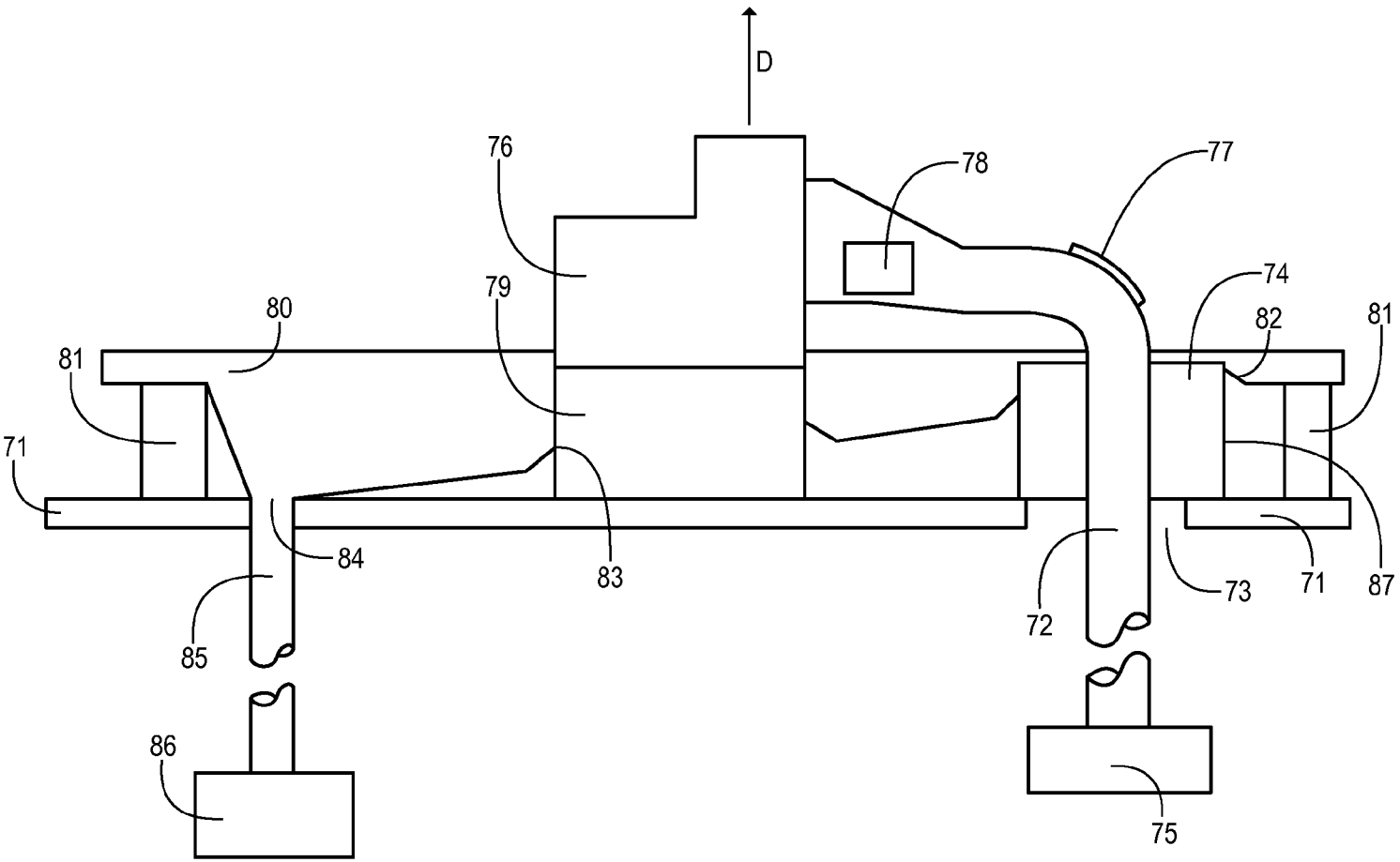
FIG. 7 depicts a cross-sectional view of an exemplary rooftop grease containment system of the present invention for use with a utility set type blower exhaust fan.

In a further embodiment of the present invention, the exhaust penetration fitting provide an insulating barrier around one or more grease ducts extending through a roof structure, wherein the one or more grease ducts turn horizontal towards a utility set type blower. Such an exhaust penetration fitting 74 is shown in FIG. 7. In this exemplary embodiment, exhaust penetration fitting 74 rests on roof structure 71 and encompasses a portion grease duct 72 extending through grease duct opening 73 in roof structure 71. Grease duct 72 extends from a grease source 75, such as a kitchen stove, to utility set type blower 76 having an air discharge direction as shown by arrow D. Grease duct 72 may contain one or more access panels, such as access panels 77 and 78, to facilitate cleaning of grease duct 72 during regularly scheduled maintenance.

As shown in FIG. 7, utility set type blower 76 desirably sits atop a base structure 79 to elevate utility set type blower 76 a desired distance above roof structure 71. Base structure 79 may comprise a variety of materials, such as those described above for forming exemplary grease pan 11 or exemplary roof curb 13. Typically, base structure 79 is formed from a non-corrosive metal, such as stainless steel.

In this embodiment, exemplary grease pan 80 rests on roof curb 81, and comprises two openings: first duct opening 82 for exhaust penetration fitting 74, and second duct opening 83 for base structure 79. Exemplary grease pan 80 also comprises drain opening 84, which is in fluid communication with drain piping 85, which directs grease and grease-containing solutions to grease collection system 86, such as a grease trap. As shown in FIG. 7, edges of exemplary grease pan 80 surrounding first duct opening 82 and second duct opening 83 may be modified in order to prevent grease and/or grease-containing solutions from entering into first duct opening 82 and second duct opening 83. Alternatively, an exhaust penetration fitting flange, such as flange 115 as shown in FIG. 5, may be used with exhaust penetration fitting 74 and base structure 79 to prevent grease and/or grease-containing solutions from entering into first duct opening 82 and second duct opening 83.

It should be noted that exhaust penetration fittings may rest directly on a roof structure or on an upper surface of a grease pan. For example, in FIGS. 6-7, exemplary exhaust penetration fittings 65 and 74 rest directly on roof structure 61 and 71 respectively. As shown in FIG. 5, exemplary exhaust penetration fitting 12 may rest directly on an upper surface of grease pan 11.

Exhaust penetration fittings suitable for use in the grease containment systems of the present invention may have any desired dimensions depending on the given grease containment system. Typically, exhaust penetration fittings have dimensions slightly larger than the outer dimensions of a grease duct opening in a roof structure (e.g., slightly larger than the outer dimensions of grease duct opening 73 in roof structure 71). Exemplary exhaust penetration fittings may have an overall length ranging from about 20.3 cm. (8 in.) to about 121.9 cm. (4 ft.); and an overall width ranging from about 20.3 cm. (8 in.) to about 121.9 cm. (4 ft.); and a height ranging from about 15.2 cm. (6 in.) to about 45.7 cm. (18 in.).

In one desired embodiment of the present invention, the exhaust penetration fitting has dimensions large enough so as to provide a clearance of 45.7 cm. (18 in.) from an outer surface of a grease duct extending through the exhaust penetration fitting. Such an exhaust penetration fitting has an overall length ranging from about 50.8 cm. (20 in.) to about 121.9 cm. (4 ft.); and an overall width ranging from about 50.8 cm. (20 in.) to about 121.9 cm. (4 ft.); and a height ranging from about 15.2 cm. (6 in.) to about 45.7 cm. (18 in.).

Exhaust penetration fittings suitable for use in the grease containment systems of the present invention are typically made from materials that (i) resist damage from water, weather, and grease, and (ii) have a material thickness that provides desired load-bearing strength when needed, such as when the exhaust penetration fitting supports an upblast exhaust fan. Suitable materials for forming exhaust penetration fittings of the present invention include, but are not limited to, metals such as stainless steel, galvanized steel, and aluminized steel or fiber-reinforced composite materials. The thickness of a given material may vary depending on the material used; however, the materials typically have a wall thickness ranging from about 1.09 mm (0.043 in) to about 3.18 mm thick (0.125 in.). Desirably, the exhaust penetration fitting is formed from galvanized steel, aluminized steel or stainless steel having a thickness ranging from about 1.09 (0.043 in.) to about 1.37 mm. (0.054 in.).

D. Exhaust Penetration Fitting Flange

As discussed above, the grease containment system of the present invention may further comprise one or more optional flanges, such as exemplary exhaust penetration fitting flange 115 shown in FIGS. 1 and 5. When present, the flange is used to prevent grease and/or grease-containing solutions from entering into an opening in a grease pan. Typically, each flange extends from an outer periphery of one or more structures positioned above or within one or more openings in a grease pan to an upper surface of the grease pan. For example, as shown in FIG. 5, exemplary exhaust penetration fitting flange 115 extends from an outer periphery of ventilated exhaust penetration fitting 12 to an upper surface 119 of grease pan 11.

Flanges may be connected to one or more structures (i.e., an exhaust penetration fitting or a base structure as described above) and/or an upper surface of a grease pan using conventional sealing means so as to form a grease-tight seal between the flange and the one or more structures. Suitable sealing methods include, but are not limited to, welding, adhesives, sealants or caulks such as endothermic or intumescent fire penetration sealants, etc. Desirably, the one or more flanges are attached to an outer periphery of one or more structures and optionally an upper surface of the grease pan.

When present, each flange typically extends outward from an outer periphery of a given structure, such as an exhaust penetration fitting, a distance ranging from about 2.5 cm. (1.0 in.) to about 10.2 cm. (4 in.).

Flanges suitable for use in the grease containment systems of the present invention are typically made from materials that resist damage from water, weather, and grease. Suitable materials for forming flanges include, but are not limited to, metals such as stainless steel, galvanized steel, and aluminized steel or fiber-reinforced composite materials. The thickness of a given material may vary depending on the material used; however, the materials typically have a wall thickness ranging from about 22 gauge to about 16 gauge. Desirably, flanges are formed from stainless steel having a thickness ranging from about 1.09 (0.043 in.) to about 1.37 mm. (0.054 in.).

E. Drain Piping

The grease containment system of the present invention further comprises optional drain piping, such as exemplary drain piping 14 shown in FIG. 1. Desirably, the drain piping extends from one or more drain openings in a grease pan to one or more grease collection devices, such as a grease trap, a grease interceptor, or a grease removal unit (GRU). The grease collection device may be positioned directly below the roof structure, or may be positioned in a remote location one or more building floors away from the grease pan. The number of drain openings and/or grease collection devices utilized in a given grease containment system will depend on a number of factors including, but not limited to, the desired capacity of the grease containment system.

The drain piping may have any desired inner diameter depending on a number of factors including, but not limited to, the desired fluid flow through the drain piping, and the distance from the drain opening of the grease pan to the grease collection device. Typically, the drain piping has an inner diameter of up to about 15.2 cm. (6.0 in.), desirably, from about 5.1 cm. (2.0 in.) to about 15.2 cm. (6.0 in.).

Drain piping suitable for use in the grease containment systems of the present invention are typically made from materials that resist damage from water, weather, and grease. Suitable materials for drain piping include, but are not limited to, metals such as stainless steel and copper, and polymeric materials, such as polyvinyl chloride. The thickness of a given material may vary depending on the material used; however, the materials typically have a wall thickness ranging from about 1.0 mm. (0.040 in.) to about 7.1 mm (0.280 in.). Desirably, the drain piping is formed from polyvinyl chloride having a thickness ranging from about 3.9 mm. (0.154 in.) to about 7.1 mm (0.280 in.).

In cold weather climates or applications involving a relatively large quantity of grease, drain piping of the grease containment system may further comprise one or more heating elements to provide heat to the drain piping. Heat prevents water and/or grease within the drain piping from solidifying, which results in continuous drainage capabilities. Suitable heating elements that may be used with the drain piping of the present invention include, but are not limited to, heat tape.

When heat tape is used, the heat tape is typically wrapped around an outer surface of the drain piping. Electricity flowing through the heat tape provides heat to the drain piping, which prevents water and/or grease from solidifying within the drain piping. As discussed above, heat tape is desirably used in cold weather climates and in applications involving a relatively large quantity of grease. For example, in drain piping systems containing one or more 90° turns, grease has a tendency to solidify and/or accumulate at the 90° turns. Heat tape may be used to prevent such accumulation.

F. Exhaust Blower Hinge Kits

As discussed above, the grease containment system of the present invention may further comprise optional exhaust blower hinge kits comprising one or more hinges, such as exemplary hinges 122 shown in FIG. 1. The hinge kits may be used to tilt an up-blast exhaust blower during cleaning, allowing access to the blower inlet, underside of the blower wheel, and the vertical exhaust ductwork.

Hinge kits may further include service hold-open retainers to prevent the exhaust blower from contacting the grease pan, the roof curb, or the roof surface. Service hold-open retainers help minimize the wear and tear associated with handling of the exhaust blower by cleaning and service personnel.

Hinge kit components (e.g., hinges, service hold-open retainers) suitable for use in the grease containment systems of the present invention are typically made from materials that resist damage from water, weather, and grease. Suitable materials for forming hinge kit components include, but are not limited to, metals such as stainless steel, carbon steel, galvanized steel, aluminum or aluminized steel. Desirably, hinge kit components are formed from stainless or galvanized steel.

G. Electrical Service Disconnect Mounts

The grease containment system of the present invention further comprises optional electrical service disconnect mounts, such as exemplary electrical service disconnect mount 16 shown in FIG. 1. Electrical service disconnect mounts (ESDM) enable disconnect of electricity to the exhaust fan. The ability to disconnect electricity to the exhaust fan is an important safety feature during routine maintenance and cleaning procedures. As shown in FIG. 1, electrical service disconnect mount 16 may be positioned next to roof curb 13. Alternatively, the electrical service disconnect mount may be positioned away from but in the vicinity of the roof curb.

In this embodiment, flexible weatherproof electrical service may be externally routed from the electrical service disconnect mount 16 to the exhaust blower eliminating the need to route electrical wiring through components such as a ventilated base fitting used to support an exhaust blower fan. Further, externally routed electrical wiring facilitates removal of the exhaust blower from a ventilated base fitting during service.

H. Weatherproof Lighting and Electrical Outlets

The grease containment system of the present invention may further comprise weatherproof lighting and/or electrical outlets. Weatherproof lighting and/or electrical outlets may be positioned along the grease containment system in one or more locations, such as exemplary electrical outlet 17 shown in FIGS. 1 and 5. Weatherproof lighting is desirable for providing additional safety measures during routine nighttime servicing and cleaning of an exhaust blower system. Further, weatherproof disconnect switches may be provided for lighting fixtures.

Duplex GFCI (Ground Fault Circuit Interrupter) outlets may also be positioned along the grease containment system in one or more locations to enhance the serviceability of the rooftop equipment. Although exemplary electrical outlet 17 is shown on a front surface of exemplary grease containment system 10 in FIGS. 1 and 5, it should be understood that one or more electrical outlets may be positioned in other locations in the vicinity of exemplary grease containment system 10. External cleaning apparatus requiring electricity may be attached to the one or more GFCI outlets to facilitate cleaning and maintenance of the exhaust blower system.

I. High-Pressure Wash Piping

The grease containment system of the present invention may further comprise optional high-pressure wash piping, such as exemplary high-pressure wash piping assembly 18 shown in FIG. 1. Wash piping may be used during cleaning of the exhaust blower system. Wash piping eliminates the need to route one or more water hoses onto and across the roof of a building during cleaning of the kitchen exhaust system. The water piping assembly may include tubing, quick disconnects, and isolation ball valves for pressure washing and/or steam cleaning processes. Water hoses may be connected to a quick disconnect or standard hose connect at a location such as shown in FIG. 1 to enable efficient cleaning of the kitchen exhaust system.

In one embodiment of the present invention, water is supplied to a high-pressure wash piping assembly, such as exemplary high-pressure wash piping assembly 18 shown in FIG. 1 on a continuous basis. In other words, the high-pressure wash piping assembly is an integral component of the building's water piping system. In an alternative embodiment, high-pressure wash piping assembly is separated from a building's water piping system, and is usable when desired, such as during a kitchen exhaust system cleaning procedure. In this alternate embodiment, a cleaning contractor is able to attach a wash equipment hose to a wash piping assembly input located, for example, within a kitchen location. The piping of the wash piping assembly leads from the input along the kitchen exhaust system ductwork to a water piping assembly outlet, such as exemplary high-pressure wash piping assembly 18 shown in FIG. 1. As discussed above, the water piping assembly outlet may comprise an isolation ball valve and a quick disconnect fitting.

In a further modification of the above alternate embodiment, one or more isolation ball valves and quick disconnect fittings may be placed along the water piping extending along the kitchen exhaust system ductwork. In this embodiment, any one of the isolation ball valves and quick disconnect fittings can be utilized to clean different sections of the ductwork through access doors positioned within the ductwork. Cleaning contractors would only need to carry one wash hose and an optional spray gun to each access panel (and each isolation ball valve and quick disconnect fitting) located along the exhaust duct system in order to clean the kitchen exhaust system ductwork.

This method of cleaning a kitchen exhaust system eliminates the need to route one or more wash hoses through the ceiling, up the side of the building, and/or across the roof during a typical cleaning operation. Further, service time is reduced, and the potential for accidents associated with multiple hoses distributed over the building and cleaning equipment is minimized.

II. Methods of Reducing Grease on the Roof of a Building

The present invention is further directed to methods of reducing an amount of grease on a rooftop. In one exemplary method of reducing an amount of grease on a rooftop of a building, the method comprises positioning a grease containment system around and beneath an exhaust fan of a rooftop kitchen exhaust system, wherein the grease containment system comprises a grease collection pan having (i) a pan volume surrounded by (a) a pan floor, (b) at least one pan side wall, and (c) a pan upper rim extending outward from an upper edge of the at least one pan side wall, (ii) at least one pan drain outlet, and (iii) at least one pan opening positioned in the pan floor, wherein a first pan opening has a size and shape so that a first grease duct extending through a roof structure and to the exhaust fan can extend through the first pan opening.

The exemplary method described above may further comprise (1) positioning the pan rim of the grease collection pan on an upper periphery of a roof curb positioned along the roof structure; (2) positioning an exhaust penetration fitting either (i) through the first pan opening of the grease collection pan or (ii) on an upper surface of the grease collection pan and surrounding the first pan opening; or both (1) and (2). In one desired embodiment of the present invention, the exhaust penetration fitting extends through the first pan opening of the grease collection pan, and provides support for the exhaust fan, such as an upblast exhaust fan. Further, the exhaust penetration fitting may further comprise (i) one or more vents in a side wall of the exhaust penetration fitting, and (ii) one or more hinges connected to the exhaust penetration fitting and a lower portion of the exhaust fan so that the exhaust fan can be tilted from a first position on the exhaust penetration fitting to a second position extending over a portion of the grease collection pan.

The method of reducing an amount of grease on a rooftop of a building may further comprise one or more steps including, but not limited to, the following steps:

(1) providing an exhaust penetration fitting flange between the exhaust penetration fitting and an upper surface of the grease collection pan;

(2) providing one or more access doors on a first grease duct extending through the roof structure and to the exhaust fan;

(3) providing one or more hinges on a lower portion of the exhaust fan so that the exhaust fan can be tilted from a first position on the exhaust penetration fitting to a second position extending over a portion of the grease collection pan; and (4) periodically cleaning one or more components of the rooftop kitchen exhaust system positioned on the roof of the building.

III. Methods of Cleaning a Kitchen Exhaust System

The present invention is further directed to methods of cleaning a rooftop kitchen exhaust system of a building. In one exemplary method of cleaning a rooftop kitchen exhaust system of a building, the method comprises (a) positioning a grease containment system around and beneath an exhaust fan of a rooftop kitchen exhaust system, wherein the grease containment system comprises a grease collection pan having (i) a pan volume surrounded by (a) a pan floor, (b) at least one pan side wall, and (c) a pan rim extending outward from an upper edge of the at least one pan side wall, (ii) at least one pan drain outlet, and (iii) at least one pan opening positioned in the pan floor, wherein a first pan opening has a size and shape so that a first grease duct extending through a roof structure and to the exhaust fan can extend through the first pan opening; (b) contacting one or more components of the rooftop kitchen exhaust system with an aqueous solution; and (c) collecting the aqueous solution and any grease dislodged from the one or more components of the rooftop kitchen exhaust system in the grease containment system, wherein the aqueous solution and the grease travel through the at least one pan drain outlet to a grease collection system.

The grease containment system used in the above-described exemplary method of cleaning a rooftop kitchen exhaust system of a building may further comprise (1) a roof curb positioned along the roof structure, wherein the pan rim is positioned on an upper periphery of the roof curb; (2) an exhaust penetration fitting either positioned (i) through the first pan opening of the grease collection pan or (ii) on an upper surface of the grease collection pan and surrounding the first pan opening; or both (1) and (2). In one desired embodiment of the present invention, the exhaust penetration fitting extends through the first pan opening of the grease collection pan, and provides support for an exhaust fan, such as an upblast exhaust fan. The exhaust penetration fitting may further comprise (i) one or more vents in a side wall of the exhaust penetration fitting, and (ii) one or more hinges connected to the exhaust penetration fitting and a lower portion of the exhaust fan so that the exhaust fan can be tilted from a first position on the exhaust penetration fitting to a second position extending over a portion of the grease collection pan.

As described above, the grease containment system may comprise a grease collection unit, such as a grease trap, located at a remote location below the rooftop. In addition, the grease collection system used in the method of cleaning a rooftop kitchen exhaust system of a building may further comprise one or more components selected from one or more electrical service disconnect mounts, one or more weatherproof lights, one or more electrical outlets, and a water piping assembly.

In one desired embodiment of the present invention, the method of cleaning a rooftop kitchen exhaust system of a building utilizes a grease containment system further comprising a water piping assembly positioned along a grease duct of a rooftop kitchen exhaust system, wherein the water piping assembly comprises water piping that extends from a kitchen to an outlet adjacent to the grease collection pan. In this desired embodiment, the method of cleaning a rooftop kitchen exhaust system of a building may further comprise (i) opening one or more access doors within the grease duct; (ii) opening one of more water outlets positioned along the water piping; and (iii) spraying water through the one or more access doors to clean interior surfaces of the grease duct.

The method of cleaning a rooftop kitchen exhaust system of a building may further comprises one or more steps including, but not limited to, the following steps:

(1) providing an exhaust penetration fitting flange between the exhaust penetration fitting and an upper surface of the grease collection pan;

(2) providing one or more access doors on a first grease duct extending through the roof structure and to the exhaust fan; and (3) providing one or more hinges on the exhaust penetration fitting and a lower portion of the exhaust fan so that the exhaust fan can be tilted from a first position on the exhaust penetration fitting to a second position extending over a portion of the grease collection pan.

The present invention provides a number of advantages over known grease containment systems including, but not limited to, improved control over grease exiting from a kitchen exhaust system, an unlimited system capacity for containing and controlling grease, the ability to control grease without the use of absorbent pads, the ability to thoroughly clean kitchen exhaust system components including, but not limited to, kitchen exhaust system ductwork and exhaust fans.

The present invention also provides one or more of the following advantages:

1) the ability to eliminate the release of fats, oils, grease and cleaning chemicals into the environment such as lakes, streams, and ponds, which is commonly associated with conventional methods of cleaning and maintaining a kitchen exhaust system;

2) the ability to eliminate grease on a roof surface, and providing a permanent separation of grease from a surrounding roofing material;

3) the ability to minimize conflict with roofing contractor supplied warranties and/or bonds;

4) the ability to eliminate punctures of roofing materials during blower handling;
5) the ability to prevent roofing material failure due to grease contamination;
6) the ability to adequately address the service needs of a kitchen exhaust system, namely, the routine maintenance and cleaning of the kitchen exhaust system without having to simultaneously or subsequently clean the roof;
7) the ability to efficiently utilize optional cleaning equipment to decrease cleaning time, and maximize cleaning efficiency;
8) the ability to provide metal at the point of exhaust ductwork penetration of a roof structure, eliminating combustible material construction from coming into close contact with a grease duct, thereby reducing the likelihood of roofing materials being ignited during a kitchen exhaust system fire; and
9) the ability to minimize fire damage to the roof structure during a kitchen exhaust system fire.

The present invention is further illustrated by the following examples, which are not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLE 1

Grease Containment System for Use on a Roof of a Building

A grease containment system similar to the one shown in FIG. 5 was assembled onto the rooftop of an existing building. The grease pan, roof curb, exhaust penetration fitting and exhaust penetration fitting flange were prepared from stainless steel having a thickness of about 1.37 mm. The grease pan had overall dimensions of: length—243.8 cm. (8 ft.), width—182.9 cm. (6 ft.), and depth—30.5 cm (12 in,). The grease pan had (i) a single duct opening in the floor of the grease pan having a square shape and a duct opening side length of 20.3 cm. (8 in.); (ii) a single drain opening in the floor of the grease pan having a circular shape and a drain opening diameter of 15.2 cm. (6.0 in.); and (iii) an upper rim having a rim length of 7.6 cm. (3 in.).

The roof curb had overall dimensions of: length—274.3 cm. (9 ft.), width—213.4 cm. (7 ft.), and height—15.2 cm. (6 in.). The roof curb had an upper periphery width of 15.2 cm. (6 in.).

The exhaust penetration fitting used was a ventilated base support for an upblast exhaust fan. The fitting had a square configuration with side lengths of 30.5 cm (12 in,) and a height of 30.5 cm (12 in,). Exhaust penetration fitting flanges were used, and extended outward from an outer periphery of ventilated base support a distance of 5.1 cm. (2 in.).

The grease containment system was used to control grease exiting an upblast exhaust fan. Further, the grease containment system was used to control grease and grease-containing solutions exiting the upblast exhaust fan during routine maintenance and cleaning of the upblast exhaust fan.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A grease containment system comprising a grease collection pan having (i) a pan volume surrounded by (a) a pan floor, (b) at least one pan side wall, and (c) a pan support rim extending outward from an outer upper edge of the at least one pan side wall and being integrally connected to the outer upper edge of the at least one pan side wall in a stationary position relative to the outer upper edge of the at least one pan side wall, said pan support rim having a lower pan support rim surface, an upper pan support rim surface, and a width extending along an outer periphery of the grease collection pan, (ii) at least one pan drain outlet, and (iii) a first pan opening positioned in the pan floor, wherein the first pan opening has a size and shape so that a first grease duct extending through a roof structure can extend through the first pan opening, further comprising a roof curb (i) extending upward from the roof structure, (ii) positioned a clearance distance from the first grease duct and the first pan opening, and (iii) having a roof curb upper periphery, said grease collection pan being positioned on the roof curb so that the lower surface of the pan support rim rests on and is supported by the roof curb upper periphery of the roof curb.

2. The grease containment system of claim 1, further comprising an exhaust penetration fitting having a size and shape so that a first grease duct extending through a roof structure can extend through the exhaust penetration fitting.

3. The grease containment system of claim 2, wherein the exhaust penetration fitting extends through the first pan opening of the grease collection pan, and an outer surface of said exhaust penetration fitting is positioned a clearance distance from an inner surface of said roof curb.

4. The grease containment system of claim 2, wherein the exhaust penetration fitting rests on an upper surface of the grease collection pan surrounding the first pan opening.

5. The grease containment system of claim 2, further comprising a first grease duct extending through the first pan opening and the exhaust penetration fitting, said first grease duct having a first grease duct outer surface and a first grease duct height.

6. The grease containment system of claim 5, wherein the first grease duct comprises a metal duct of a kitchen exhaust system.

7. The grease containment system of claim 2, wherein the exhaust penetration fitting is ventilated and is capable of supporting an upblast exhaust fan.

8. The grease containment system of claim 2, further comprising an exhaust penetration fitting flange extending outward from an outer periphery of the exhaust penetration fitting to an upper surface of the grease collection pan.

9. The grease containment system of claim 2, further comprising one or more hinges positioned along an outer surface of the exhaust penetration fitting, said one or more hinges being suitable for attachment to an exhaust fan positioned above and on the exhaust penetration fitting.

10. The grease containment system of claim 1, further comprising at least one pipe extending from the at least one pan drain outlet of the grease collection pan.

11. The grease containment system of claim 10, wherein the at least one pipe extends to a grease collection unit, said grease collection unit being positioned below the roof top surface.

12. The grease containment system of claim 11, wherein the grease collection unit comprises a grease trap.

13. The grease containment system of claim 1, further comprising at least one component selected from the group consisting of one or more electrical service disconnect mounts, one or more weatherproof lights, one or more electrical outlets, and a water piping assembly.

14. A method of reducing an amount of grease on a rooftop of a building, wherein the method comprises:

(a) providing a grease containment system around and beneath an exhaust fan of a rooftop kitchen exhaust system, wherein said grease containment system comprises:

(1) a grease collection pan having (i) a pan volume surrounded by (a) a pan floor, (b) at least one pan side wall, and (c) a pan support rim extending outward from an outer upper edge of the at least one pan side wall and being integrally connected to the outer upper edge of the at least one pan side wall in a stationary position relative to the outer upper edge of the at least one pan side wall, said pan support rim having a lower pan support rim surface, an upper pan support rim surface, and a width extending along an outer periphery of the grease collection pan, (ii) at least one pan drain outlet, and (iii) a first pan opening positioned in the pan floor, wherein the first pan opening has a size and shape so that a first grease duct extending through a roof structure and to the exhaust fan can extend through the first pan opening, (2) a roof curb (i) extending upward from the roof structure, (ii) positioned a clearance distance from the first grease duct and the first pan opening, and (iii) having a roof curb upper periphery, wherein the lower surface of the pan rim is positioned on and supported by said upper periphery of the roof curb, and (3) an exhaust penetration fitting either positioned (i) through the first pan opening of the grease collection pan or (ii) on an upper surface of the grease collection pan and surrounding the first pan opening.

15. The method of claim 14, wherein the exhaust penetration fitting extends through the first pan opening of the grease collection pan, and provides support for the exhaust fan, said exhaust penetration fitting further comprising (i) one or more vents in a side wall of the exhaust penetration fitting, and (ii) one or more hinges connected to the exhaust penetration fitting and a lower portion of the exhaust fan so that the exhaust fan can be tilted from a first position on the exhaust penetration fitting to a second position extending over a portion of the grease collection pan.

16. The method of claim 14, wherein the method further comprises one or more of the following steps:

providing an exhaust penetration fitting flange between the exhaust penetration fitting and an upper surface of the grease collection pan;

providing one or more access doors on a first grease duct extending through the roof structure and to the exhaust fan;

providing one or more hinges on the exhaust penetration fitting and a lower portion of the exhaust fan so that the exhaust fan can be tilted from a first position on the exhaust penetration fitting to a second position extending over a portion of the grease collection pan; and periodically cleaning one or more components of the rooftop kitchen exhaust system positioned on the roof of the building.

17. The method of claim 14, wherein the method further comprises:

(b) contacting one or more components of the rooftop kitchen exhaust system with an aqueous solution; and (c) collecting the aqueous solution and any grease dislodged from the one or more components of the rooftop kitchen exhaust system in the grease containment system, wherein the aqueous solution and the grease travel through the at least one pan drain outlet to a grease collection system.

18. The method of claim 14, wherein the grease containment system comprises a grease trap located at a remote location below the rooftop.

19. The method of claim 14, wherein the grease containment system further comprises at least one component selected from the group consisting of one or more electrical service disconnect mounts, one or more weatherproof lights, one or more electrical outlets, and a water piping assembly.

20. The method of claim 14, wherein the grease containment system further comprises a water piping assembly positioned along a grease duct of a rooftop kitchen exhaust system, said water piping assembly comprising water piping that extends from a kitchen to an outlet adjacent to the grease collection pan; wherein said method further comprises:

opening one or more access doors within the grease duct;

opening one of more water outlets positioned along the water piping; and spraying water through the one or more access doors to clean interior surfaces of the grease duct.

21. The grease containment system of claim 1, wherein the grease collection pan has a load-bearing strength that enables a trim back of any combustible roof decking material away from the first grease duct, the trim back providing a clearance between (i) an outer surface of the first grease duct and (ii) any combustible roof decking material of at least about 45.7 cm (18 in); and said grease containment system further comprises a trim back of any combustible roof decking material beneath the pan floor of the grease collection pan so as to provide a clearance between the first grease duct and any combustible roof decking material of at least about 45.7 cm (18 in).

22. The method of claim 14, wherein the grease containment system further comprises a trim back of any combustible roof decking material beneath the pan floor of the grease collection pan so as to provide a clearance between the first grease duct and any combustible roof decking material of at least about 45.7 cm (18 in).

23. A grease containment system comprising:

a grease collection pan having (i) a pan volume surrounded by (a) a pan floor, (b) at least one pan side wall, and (c) a pan support rim extending outward from an outer upper edge of the at least one pan side wall and being integrally connected to the outer upper edge of the at least one pan side wall in a stationary position relative to the outer upper edge of the at least one pan side wall, said pan support rim having a lower pan support rim surface, an upper pan support rim surface, and a width extending along an outer periphery of the grease collection pan, (ii) at least one pan drain outlet, and (iii) a first pan opening positioned in the pan floor, wherein the first pan opening has a size and shape so that a first grease duct extending through a roof structure can extend through the first pan opening, said grease collection pan having (1) a load-bearing strength that enables a trim back of combustible roof decking material beneath the pan floor of the grease collection pan so as to provide a clearance between the first grease duct and any combustible roof decking material of at least about 45.7 cm (18 in), and (2) pan dimensions that enable all portions of an exhaust fan to remain over the grease collection pan even when the exhaust fan is tilted from a first operational position to a second temporary position during cleaning of the exhaust fan, and a roof curb extending upward from the roof structure and having a roof curb upper periphery, said grease collection pan being positioned on the roof curb so that the lower surface of the pan support rim rests on and is supported by the roof curb upper periphery of the roof curb.

24. The grease containment system of claim 23, wherein the grease containment system further comprises an exhaust penetration fitting either positioned (i) through the first pan opening of the grease collection pan or (ii) on an upper surface of the grease collection pan and surrounding the first pan opening, said exhaust penetration fitting having a size and shape so that a first grease duct extending through a roof structure can extend through the exhaust penetration fitting.

25. The grease containment system of claim 23, wherein the grease containment system further comprises a trim back of any combustible roof decking material beneath the pan floor of the grease collection pan so as to provide a clearance between the first grease duct and any combustible roof decking material of at least about 45.7 cm (18 in).

* * * * *